US008607525B2

(12) United States Patent
Trotter

(10) Patent No.: US 8,607,525 B2
(45) Date of Patent: Dec. 17, 2013

(54) SYSTEMS AND METHODS FOR PROVIDING A WATERPROOFING FORM FOR STRUCTURAL WATERPROOFING

(71) Applicant: Robert Mike Trotter, Doraville, GA (US)

(72) Inventor: Robert Mike Trotter, Doraville, GA (US)

( * ) Notice: Subject to any disclaimer, the term of this patent is extended or adjusted under 35 U.S.C. 154(b) by 0 days.

(21) Appl. No.: 13/651,753

(22) Filed: Oct. 15, 2012

(65) Prior Publication Data

US 2013/0036705 A1 Feb. 14, 2013

Related U.S. Application Data

(62) Division of application No. 12/583,475, filed on Aug. 21, 2009, now Pat. No. 8,312,682.

(51) Int. Cl.
*E04G 23/00* (2006.01)

(52) U.S. Cl.
USPC ..... 52/741.4; 52/302.6; 52/169.5; 52/408; 52/97

(58) Field of Classification Search
USPC ..... 52/169.5, 302.3, 302.6, 58, 97, 741.4, 52/408
See application file for complete search history.

(56) References Cited

U.S. PATENT DOCUMENTS 2,645,824 A * 7/1953 Titsworth ..... 52/302.3
2,657,570 A * 11/1953 Moore ..... 52/302.4
2,703,002 A * 3/1955 Suskind ..... 52/302.3
3,287,866 A * 11/1966 Bevilacqua ..... 52/169.5
3,304,672 A * 2/1967 Bakke ..... 52/169.5
3,344,569 A * 10/1967 Cotten ..... 52/287.1
3,428,077 A * 2/1969 Scarfe ..... 137/363
3,822,734 A * 7/1974 Tombu ..... 160/383
3,850,193 A * 11/1974 Guzzo ..... 137/362
3,950,900 A * 4/1976 Simpson ..... 52/22
3,961,661 A * 6/1976 Tombu ..... 160/328
3,975,467 A * 8/1976 Beck ..... 261/30
3,982,306 A * 9/1976 Curry ..... 24/462
4,103,598 A * 8/1978 Cooper ..... 454/186
4,231,141 A * 11/1980 Derrick et al. ..... 24/462
4,245,443 A * 1/1981 Beechen ..... 52/169.5
4,265,064 A * 5/1981 Parezo ..... 52/302.3
4,333,281 A * 6/1982 Scarfone ..... 52/169.5
4,381,630 A * 5/1983 Koester ..... 52/169.5
4,403,642 A * 9/1983 Morris ..... 160/380
4,538,386 A * 9/1985 DiCello ..... 52/302.3
4,590,722 A * 5/1986 Bevelacqua ..... 52/302.3
4,612,742 A * 9/1986 Bevilacqua ..... 52/169.5
4,625,490 A * 12/1986 Baslow ..... 52/717.05

(Continued)

*Primary Examiner* — William Gilbert
*Assistant Examiner* — James Ference
(74) *Attorney, Agent, or Firm* — Benjamin C. Wiles, Esq.; Robert R. Elliott, Jr.; Troutman Sanders LLP

(57) ABSTRACT

The present system and method enables water entering a dwelling or structure to be contained and removed, while preventing evaporation of the water into the interior of the dwelling. Embodiments of the present invention can comprise a waterproofing system comprising a waterproofing form, affixable to a first surface of a wall at a mounting angle, and comprising a vapor barrier retainer for detachably affixing a vapor barrier to the waterproofing form, and a gutter channel, disposed at a pitch angle, and in fluid communication with the first surface of the wall, the vapor barrier, and a collection area, where the pitch angle and the mounting angle are the same angle, and where the pitch angle causes the water to flow through the gutter channel to the collection area for removal.

17 Claims, 12 Drawing Sheets

(56) References Cited

U.S. PATENT DOCUMENTS 4,745,716 A * 5/1988 Kuypers ..... 52/169.5
4,757,651 A * 7/1988 Crites ..... 52/169.5
4,805,330 A * 2/1989 Bubernak ..... 40/617
4,837,991 A * 6/1989 Shaw ..... 52/98
4,841,687 A * 6/1989 Navetta ..... 52/58
4,845,910 A * 7/1989 Hanson et al. ..... 52/287.1
4,869,032 A * 9/1989 Geske ..... 52/169.5
4,930,272 A * 6/1990 Bevilacqua ..... 52/302.3
4,986,332 A * 1/1991 Lanuza ..... 160/327
5,014,486 A * 5/1991 Mayle ..... 52/718.01
5,035,095 A * 7/1991 Bevilacqua ..... 52/169.5
5,044,821 A * 9/1991 Johnsen ..... 405/50
5,248,225 A * 9/1993 Rose ..... 405/229
5,314,313 A * 5/1994 Janesky ..... 417/63
5,367,842 A * 11/1994 Janesky ..... 52/169.5
5,371,980 A * 12/1994 Dix ..... 52/34
5,398,471 A * 3/1995 Spagnolo ..... 52/412
5,495,696 A * 3/1996 Repka ..... 52/169.5
5,501,044 A * 3/1996 Janesky ..... 52/169.5
5,551,797 A * 9/1996 Sanford ..... 405/36
5,630,299 A * 5/1997 Jackman et al. ..... 52/169.5
5,634,741 A * 6/1997 Tremblay et al. ..... 405/43
5,642,967 A * 7/1997 Swain et al. ..... 405/229
5,694,723 A * 12/1997 Parker ..... 52/169.5
5,765,323 A * 6/1998 Bevilacqua ..... 52/169.5
5,771,643 A * 6/1998 Parker ..... 52/169.5
5,784,838 A * 7/1998 Phillips ..... 52/169.5
5,794,388 A * 8/1998 Jackman ..... 52/169.5
5,809,709 A * 9/1998 Ryan et al. ..... 52/222
5,820,296 A * 10/1998 Goughnour ..... 405/43
5,836,115 A * 11/1998 Clay et al. ..... 52/169.5
5,857,297 A * 1/1999 Sawyer ..... 52/169.5
5,860,259 A * 1/1999 Laska ..... 52/302.3
5,931,603 A * 8/1999 Swain et al. ..... 405/229
6,122,874 A * 9/2000 Smerilli ..... 52/408
6,164,364 A * 12/2000 Morris ..... 160/327
6,230,468 B1 * 5/2001 Klaus ..... 52/741.11
6,238,766 B1 * 5/2001 Massett et al. ..... 428/99
6,241,421 B1 * 6/2001 Harvie et al. ..... 405/45
6,308,470 B1 * 10/2001 Durkovic ..... 52/169.5
6,405,508 B1 * 6/2002 Janesky ..... 52/741.4
6,410,118 B1 * 6/2002 Reicherts et al. ..... 428/141
6,550,190 B2 * 4/2003 Ruiz et al. ..... 52/169.5
6,575,666 B1 * 6/2003 Janesky ..... 405/270
6,598,360 B1 * 7/2003 Pratt ..... 52/169.5
6,619,001 B1 * 9/2003 Pratt ..... 52/169.5
6,634,144 B1 * 10/2003 Moore et al. ..... 52/169.5
6,672,016 B2 * 1/2004 Janesky ..... 52/169.5
6,691,472 B2 * 2/2004 Hubert ..... 52/169.5
6,823,633 B2 * 11/2004 Ryan ..... 52/302.1
6,904,723 B1 * 6/2005 Moore et al. ..... 52/169.5
6,964,136 B2 * 11/2005 Collins et al. ..... 52/209
7,143,558 B2 * 12/2006 Trotter ..... 52/302.1
7,380,374 B1 * 6/2008 Pratt ..... 52/169.5
7,546,719 B1 * 6/2009 Guevara ..... 52/716.2
7,621,079 B2 * 11/2009 Takagi et al. ..... 52/169.5
7,810,291 B2 * 10/2010 McPherson ..... 52/302.3
7,823,355 B1 * 11/2010 Hohmann, Jr. ..... 52/513
7,832,156 B2 * 11/2010 Trotter ..... 52/169.5
7,836,640 B1 * 11/2010 Pratt ..... 52/61
8,186,127 B1 * 5/2012 Pratt ..... 52/741.11
2001/0023564 A1 * 9/2001 Phillips ..... 52/302.1
2002/0139068 A1 * 10/2002 Janesky ..... 52/169.5
2002/0152693 A1 * 10/2002 Krogstad ..... 52/58
2002/0152696 A1 * 10/2002 Ruiz et al. ..... 52/169.5
2003/0046888 A1 * 3/2003 Ryan ..... 52/302.1
2003/0115814 A1 * 6/2003 Nielsen ..... 52/302.1
2003/0126810 A1 * 7/2003 Brunson et al. ..... 52/169.5
2003/0156905 A1 * 8/2003 Hubert ..... 405/229
2003/0177727 A1 * 9/2003 Gatherum ..... 52/302.6
2004/0003558 A1 * 1/2004 Collins et al. ..... 52/302.1
2005/0198916 A1 * 9/2005 Janesky ..... 52/169.5
2005/0204653 A1 * 9/2005 Matthews ..... 52/169.5
2005/0210772 A1 * 9/2005 Janesky ..... 52/168
2006/0032158 A1 * 2/2006 Moule ..... 52/169.5
2006/0112653 A1 * 6/2006 Hogenson ..... 52/169.5
2006/0137289 A1 * 6/2006 Cotten ..... 52/717.02
2006/0150551 A1 * 7/2006 Bounds et al. ..... 52/302.1
2006/0156641 A1 * 7/2006 Takagi et al. ..... 52/62
2006/0283113 A1 * 12/2006 Trotter ..... 52/302.3
2007/0044396 A1 * 3/2007 Janesky ..... 52/169.5
2007/0068093 A1 * 3/2007 Grange et al. ..... 52/97
2007/0094952 A1 * 5/2007 Niemczyk ..... 52/169.5
2007/0169425 A2 * 7/2007 Takagi et al. ..... 52/62
2007/0175112 A1 * 8/2007 Janesky ..... 52/169.5
2007/0175113 A1 * 8/2007 Moule ..... 52/169.5
2007/0180785 A1 * 8/2007 Trotter ..... 52/302.1
2007/0224003 A1 * 9/2007 Janesky ..... 405/270
2007/0294965 A1 * 12/2007 Andras ..... 52/169.5
2007/0294966 A1 * 12/2007 Andras ..... 52/169.5
2008/0016808 A1 * 1/2008 Pilz ..... 52/302.6
2008/0028696 A1 * 2/2008 Fennell ..... 52/169.5
2008/0104910 A1 * 5/2008 Andras et al. ..... 52/302.3
2008/0128030 A1 * 6/2008 Lewis ..... 137/265
2008/0190045 A1 * 8/2008 Janesky ..... 52/169.5
2008/0295439 A1 * 12/2008 Janesky ..... 52/589.1
2009/0183445 A1 * 7/2009 McPherson ..... 52/169.5
2010/0229485 A1 * 9/2010 Wilkerson et al. ..... 52/302.3

* cited by examiner

SYSTEMS AND METHODS FOR PROVIDING A WATERPROOFING FORM FOR STRUCTURAL WATERPROOFING

CROSS-REFERENCE TO RELATED APPLICATION

This application is a divisional of, and claims priority to, U.S. patent application Ser. No. 12/583,475, entitled "Systems and Methods for Providing a Waterproofing Form for Structural Waterproofing," filed 21 Aug. 2009, which is incorporated herein by reference in its entirety as if fully set forth below.

BACKGROUND OF THE INVENTION

1. Field of the Invention

The present invention relates generally to relieving and eliminating water problems associated with the exterior walls of a structure and, more particularly, to an apparatus and method for containing the moisture that seeps through the exterior walls of a structure and removing it therefrom.

2. Description of the Related Art

The foundations and exterior walls of buildings often experience water problems due to a variety of causes. When exterior walls that are below grade are constructed, the surrounding soil must be removed prior to construction and then replaced after the foundation and walls are complete. As a result, the exterior walls can become damaged as soil settles outside of the foundation. Furthermore, a negative grade sloping toward the exterior walls can be formed due to such settling. With the negative grade, the force of gravity causes water and soil to move toward the walls, creating positive hydrostatic pressure. This pressure can cause cracking of and seepage through the exterior walls and floor allowing moisture to enter the building.

Additional water problems can be caused by water accumulating around and under walls and foundations, or by rising ground water during rainy parts of the year. All of these sources are especially prevalent in basements and crawl spaces. When water enters a dwelling, either through the walls, the floor, or through other sources, many problems arise, including, among other things, damage to the physical structure and a decrease in the indoor air quality.

Many systems exist to control or direct water seepage thorough the interior walls of a structure. Existing drainage systems, however, use exposed drains and do not fully sequester water seeping into the structure from the living spaces therein. This presents an environment where, for example and not limitation, water can 1) evaporate off the walls and into the living space before it enters the drainage system or 2) can evaporate out of the drainage system and back into the living space after entering the system.

This can create an environment, which at nearly 100% relative humidity, is rife with, for example, mold, mildew, and bacteria. This can also enable excessive amounts of radon gas to enter the dwelling.

SUMMARY OF THE INVENTION

The present system and method enables water entering a dwelling or structure to be contained and removed, while preventing evaporation of the water into the interior of the dwelling. Embodiments of the present invention can comprise a waterproofing system comprising a waterproofing form, which can be affixable to a first surface of a wall at a mounting angle, and can comprise a vapor barrier retainer for detachably affixing a vapor barrier to the waterproofing form, and a gutter channel, disposed at a pitch angle, and in fluid communication with the first surface of the wall, the vapor barrier, and a collection area, where the pitch angle and the mounting angle can be the same angle, and where the pitch angle can cause the water to flow through the gutter channel to the collection area for removal.

In some embodiments, the collection area can comprise a reservoir and a sump pump. In other embodiments, the collection area can comprise a connection to an existing drain in the dwelling. In other embodiments, the collection area can comprise a conduit that provides fluid communication between the interior an exterior of the dwelling, and a one-way valve to prevent backflow, from the exterior to the interior of the dwelling, of air or fluid in the conduit.

In some embodiments, the waterproofing form can further comprise a wicking channel, for securing a wicking felt to the waterproofing form, and comprising holes in fluid communication with the gutter channel. Embodiments of the present invention can further comprise a plurality of spacers, where the spacers can comprise a material that is sufficiently compliant to enable penetration of a fastener but dense enough to support and control the path of the fastener as it penetrates the wall. In some embodiments, the spacers can comprise aluminum. In other embodiments, the mounting angle is between 0.5 and 15 degrees below level. In still other embodiments, the vapor barrier retainer can be in fluid communication with the first surface of the wall and the vapor barrier for receiving water and directing it to a collection area for removal.

Embodiments of the present invention can also comprise a waterproofing system comprising a waterproofing form comprising a vapor barrier retainer for affixing the vapor barrier to the waterproofing form, a gutter channel for receiving water and directing it to a collection area for removal, and a wicking channel, for securing a wicking felt to the waterproofing form, and comprising holes in fluid communication with the gutter channel. In other embodiments, the waterproofing form can further comprise one or more stiffeners for increasing the longitudinal stiffness of the waterproofing form.

In some embodiments, the vapor barrier retainer can further comprise an upright portion of the waterproofing form, a flap, hingeably coupled to the upright portion, and disposed such that a cavity is formed between the flap and the upright portion, and a retainer for retaining the flap in a close position such that a vapor barrier is at least partially disposed in the cavity and is trapped between the flap and the retainer. In other embodiments, a first portion of a floor of the gutter channel is substantially horizontal and a second portion of the floor of the gutter channel is angled in an upward manner creating a void underneath at least a portion of the gutter channel.

Embodiments of the present invention can further comprise a method for waterproofing comprising creating a trench by removing a portion of a floor where it abuts a first surface of a wall, attaching a vapor barrier to a portion of the first surface of the wall, attaching a waterproofing form to the first surface of the wall at an installed angle, providing a collection means for collecting water collected in the waterproofing form, inserting the vapor barrier into a vapor barrier retainer on the waterproofing form, and filling the trench to restore the portion of the floor previously removed.

In some embodiments, the method can further comprise inserting a spacer between the waterproofing form and the first surface of the wall, and inserting a fastener through the waterproofing form and the spacer and into the wall. In some embodiments, the waterproofing form is attached to the first surface of the wall at an installed angle between 0.5 and 15 degrees below level. Embodiments of the present invention can further comprise a method comprising inserting a first end of a wicking material in a wicking channel located on the waterproofing form, and positioning a second end of the wicking material to wick water from underneath the floor into the waterproofing form.

In some embodiments, filling the trench can comprise filling a lower portion of the trench with a first binder that is substantially free of aggregate, and filling the remainder of the trench with a second binder that contains aggregate. In some embodiments, the first binder can be hydraulic cement and the second binder can be concrete. In some embodiments, at least a portion of the waterproofing form is disposed above the level of the floor.

To the accomplishment of the foregoing and related ends, the following description and annexed drawings set forth in detail certain illustrative aspects and implementations of the invention. These are indicative of but a few of the various ways in which the principles of the invention may be employed. Other aspects, advantages, and novel features of the invention will become apparent from the following detailed description of the invention when considered in conjunction with the drawings.

DETAILED DESCRIPTION OF THE PREFERRED EMBODIMENTS

Figure 1:
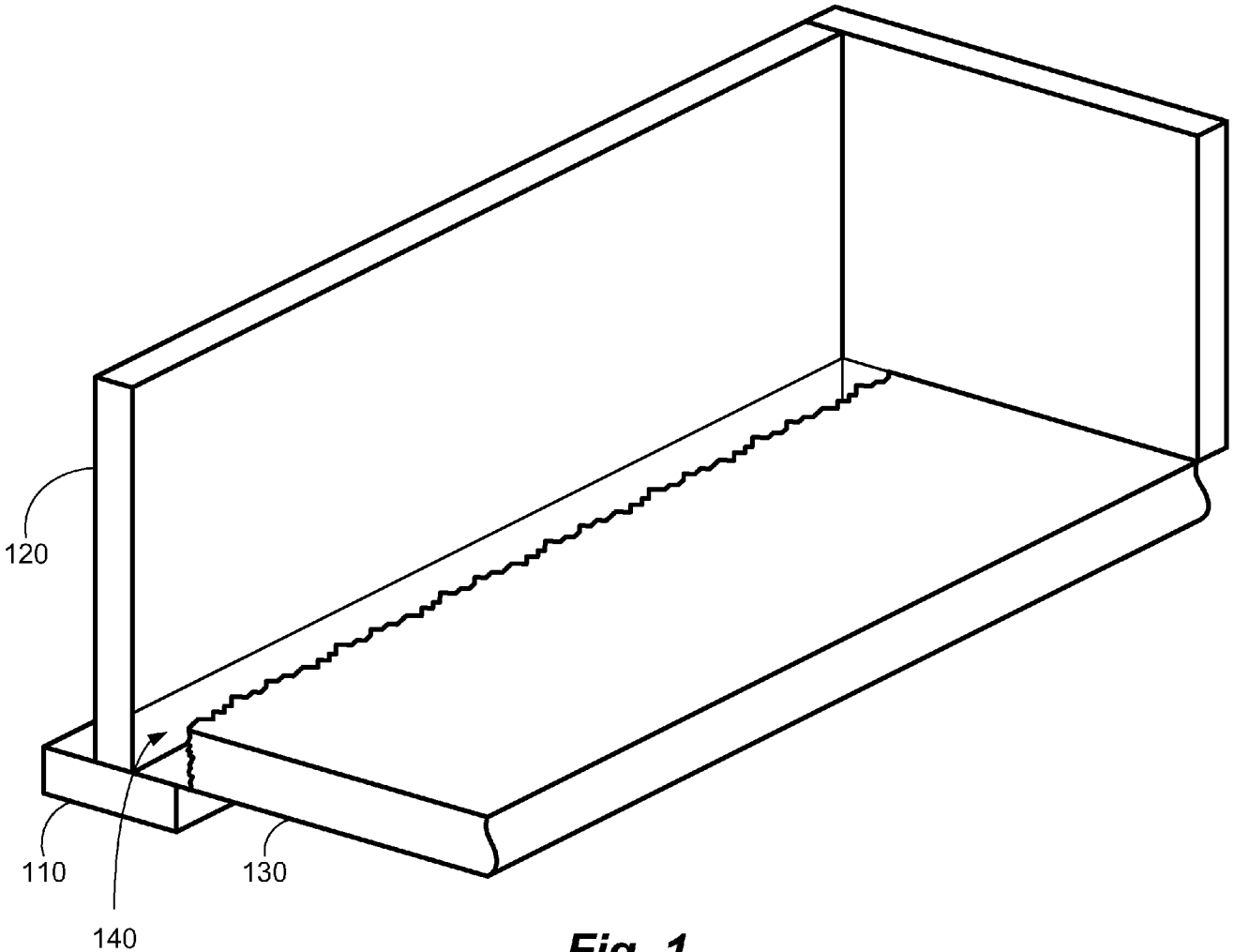
FIG. 1 depicts a perspective view of a trench between a floor and a ceiling used for foundation repair and waterproofing.

Embodiments of the present invention can comprise a waterproofing system comprising a waterproofing form, affixable to a first surface of a wall at a mounting angle, and comprising a vapor barrier retainer for detachably affixing a vapor barrier to the waterproofing form, and a gutter channel, disposed at a pitch angle, and in fluid communication with the first surface of the wall, the vapor barrier, and a collection area, wherein the pitch angle and the mounting angle are the same angle, and wherein the pitch angle causes the water to flow through the gutter channel to the collection area for removal.

Embodiments of the present invention can be understood more readily by reference to the following detailed description and the examples included herein. Before the embodiments of the devices and methods according to the present invention are disclosed and described, it is to be understood that this invention is not limited to the embodiments described within this disclosure. Numerous modifications and variations therein will be apparent to those skilled in the art remain within the scope of the invention. It is also to be understood that the terminology used herein is for describing specific embodiments only, and is not intended to be limiting.

Unless otherwise noted, the terms used herein are to be understood according to conventional usage by those of ordinary skill in the relevant art. In addition to the definitions of terms provided below, it is to be understood that as used in the specification and in the claims, "a" or "an" can mean one or more, depending upon the context in which it is used.

Embodiments of the present invention are directed towards a system for capturing and removing water seeping through the exterior walls of a structure. More specifically, embodiments of the present invention are directed to a device that can be installed between the exterior walls and foundation of a structure, and can provide a waterproof barrier in concert with a gutter to direct water seeping through the exterior walls or floor of a structure to a collection point for removal from the structure.

To facilitate an understanding of the principles and features of the invention, it is explained hereinafter with reference to its implementation in an illustrative embodiment. In particular, embodiments of the present invention are described in the context of being a basement water removal system. Because of its structure, embodiments of the present invention can be used to form a gutter encased in concrete that provides a permanent repair to waterproofing issues. Additionally, because embodiments of the present invention enable long runs of the gutter to be installed as a single unit, repairs are affected quickly and cost-effectively.

Embodiments of the invention, however, are not limited to use in basements or crawl spaces. Rather, embodiments of the invention can be used in any location where water seeping through the external structure of a building is undesirable. Thus, the water removal system described herein can find utility in any structure in which water infiltration is present and undesirable.

The materials described hereinafter as making up the various elements of the system of the invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention, for example.

Referring now to the figures, FIG. 1 depicts a building structure. When building a building, the ground can be excavated, where needed, and footings 110 can be poured around the perimeter of the building (the "footprint" of the building.) Additional footings 110 can also be poured inside the footprint to support, for example, interior walls, fireplaces, or bathrooms. The exterior walls 120 can then be poured or erected, depending on their material, on top of the footings 110.

When construction is complete, the previously excavated areas around the exterior walls 120 can be backfilled. It is important, however, that during the backfilling process care is taken to create a positive grade, i.e., such that the grade is contoured to slope away from the house. This can enable water to run away from the house and minimizes pooling at the exterior walls 120 and floor 130.

Unfortunately, improper grading and settling, among other things, can cause many houses to have negative grades. This can create a situation where water runs toward the building and pools against the exterior walls 120 and floor 130. This pooling, coupled with extreme pressure created by the weight of the soil used to backfill, can create positive hydrostatic pressure that can drive water through the exterior walls 120 and floor 130. The hydrostatic pressure can also cause cracks in the footings 110, walls 120, and floor 130, which can increase water infiltration. In filtration can also be caused or exacerbated by standing or rising water due to, among other things, rainfall or high water tables.

To begin a waterproofing repair, a portion of the floor 130 can removed, with a jackhammer or other suitable means, where it meets the wall, which can create a trench 140. If the exterior walls 120 and floor 130 are sitting on a footing 110, the trench 140 can be dug out down to the footing. The footing 110 can provide a convenient platform on which to install what is previously known in the art as a French drain 210.

Figure 2A:
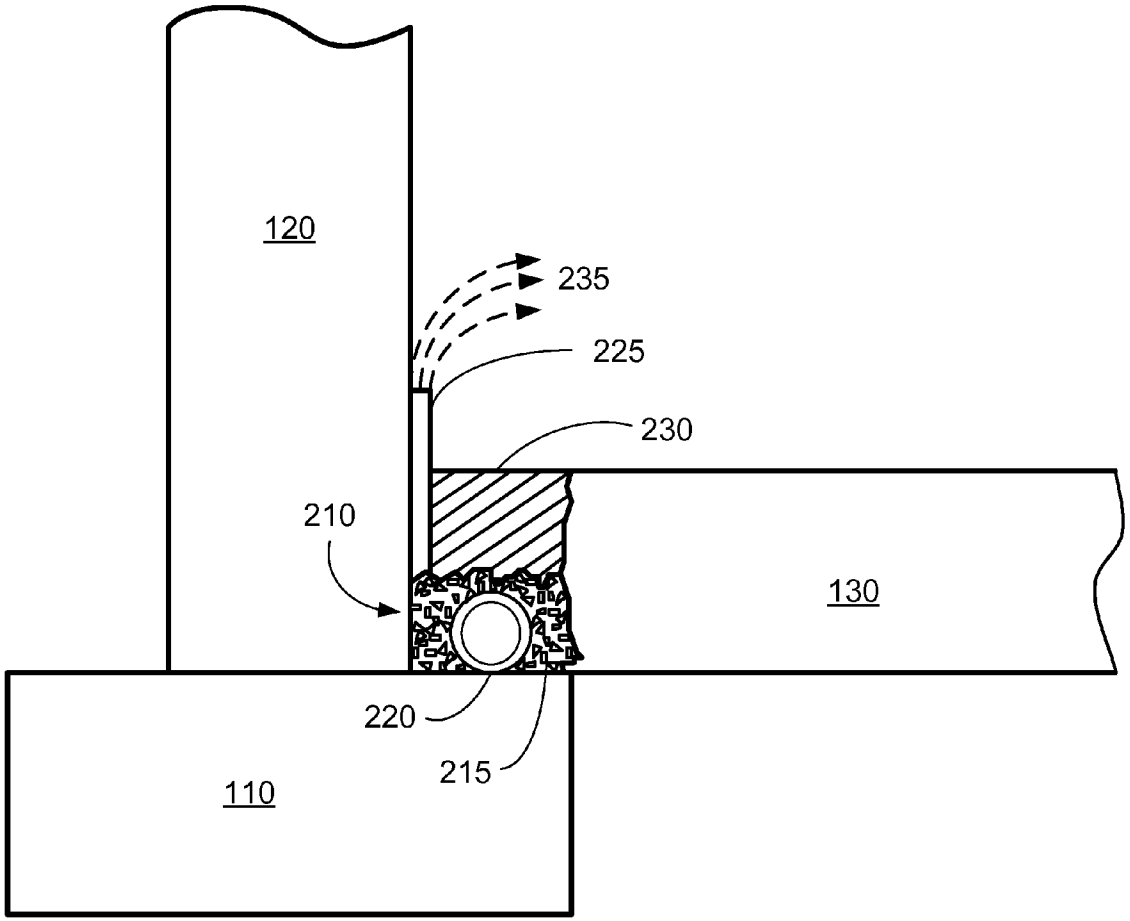
Fig. 2a Prior Art
FIG. 2*a* depicts an end view of a conventional French drain type of waterproofing repair.
Figure 2B:
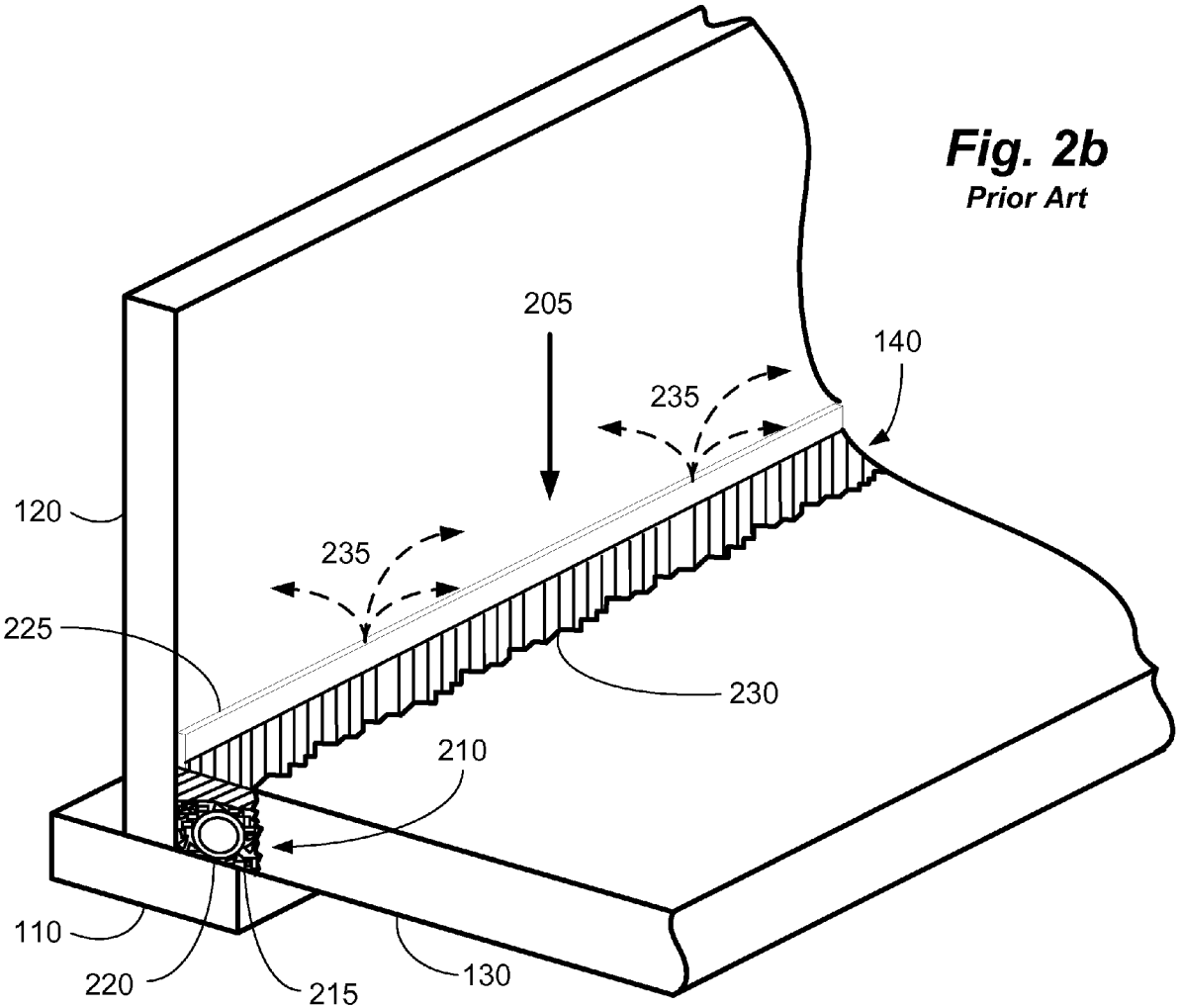
Fig. 2b Prior Art
FIG. 2*b* depicts a perspective, side view of the conventional French drain type of waterproofing repair.

FIGS. 2*a* and 2*b* illustrate a French drain 210, which can be created by first placing a layer of gravel 215, or other suitable aggregate, on the footing 110. The drain can then be completed by placing a suitable conduit 220, such as a piece of perforated pipe, on top of the gravel 215, and covering the conduit 220 with additional gravel. In some instances, the conduit 220 can be encased in a silt sock, or other suitable filtering material, to prevent dirt and other debris from entering and clogging the conduit 220.

After a suitable French drain has been created, a channel 225 can be affixed to the exterior wall 120. The channel can provide a path for water 205 seeping through, and running down, the wall 120 to enter the French drain 210. Finally, the remaining portion of the trench 140, i.e., the portion that is not occupied with the French drain 210 can be filled with concrete 230, or other suitable binder material, to restore the surface of the floor 130.

The French drain 210 is intended to contain the water seeping down the wall 120 and enable it to percolate slowly into the surrounding soil, thus removing the water from the structure. Unfortunately, because the French drain 210 is open to the interior of the building via the channel 225, moisture 235 in the French drain 210 can freely evaporate back into the room. This moisture 235, if not removed can create an unhealthy atmosphere that is ideal for mold, mildew, and other microbial growth. Removal of moisture 235 from the living space then requires other means, such as, for example, a dehumidifier, which can be expensive and can increase electricity bills.

Figure 3A:
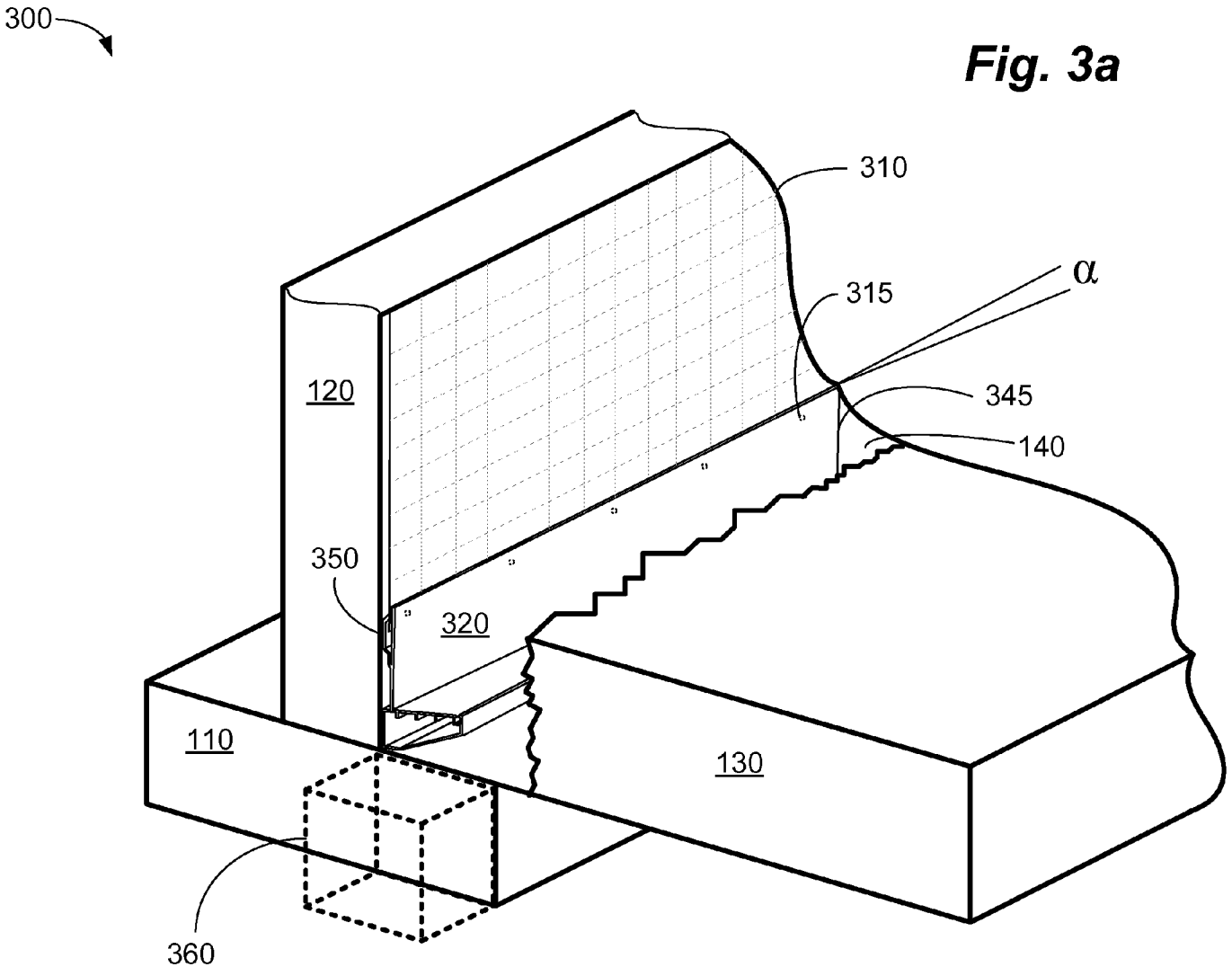
FIG. 3*a* depicts a perspective, side view of a waterproofing form and a vapor barrier installed in the trench between the floor and the wall in accordance with some embodiments of the present invention.
Figure 3B:
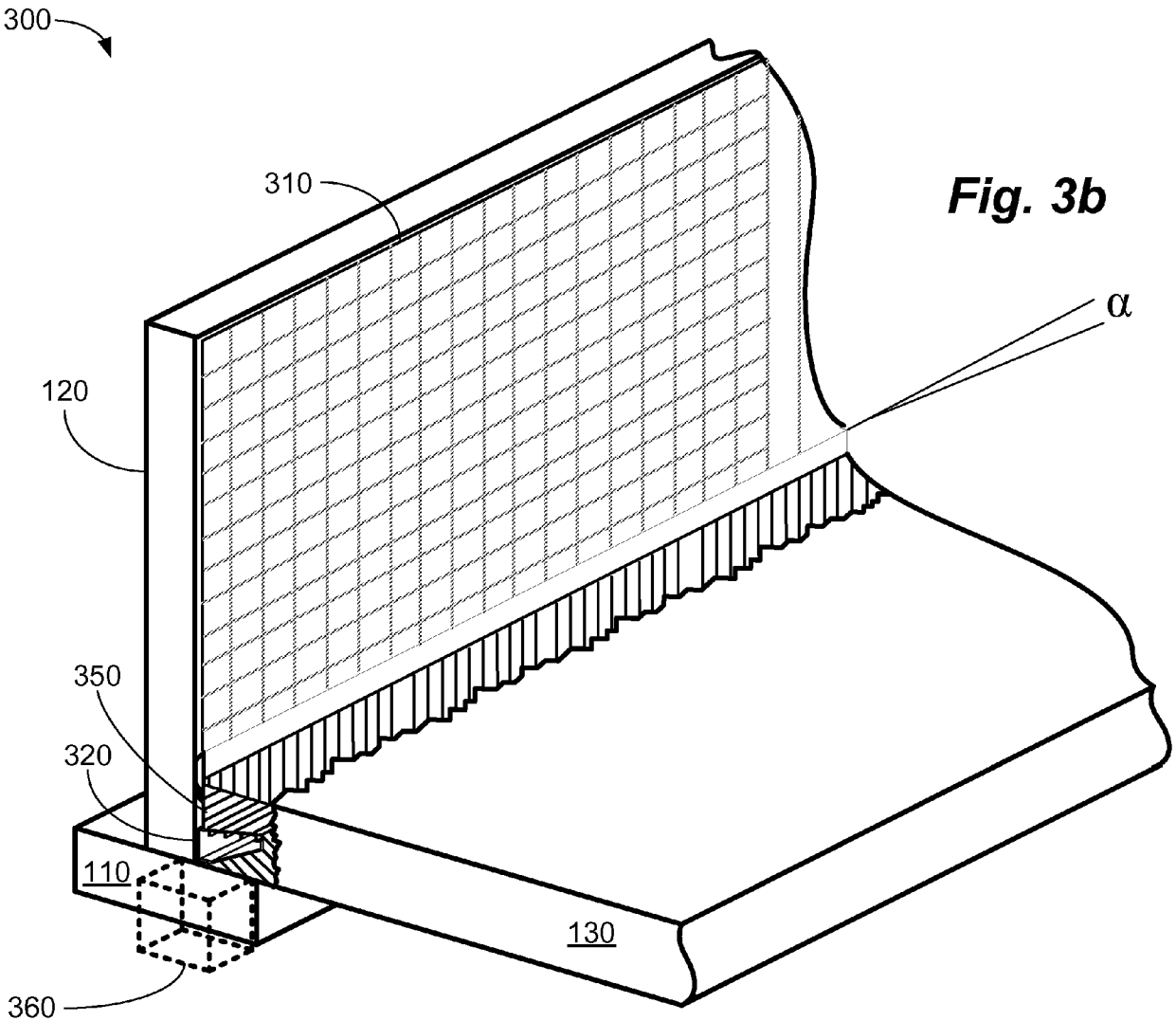
FIG. 3*b* depicts a perspective, side view of the waterproofing form and the vapor barrier installed in the trench between the floor and the wall and covered in accordance with some embodiments of the present invention.

As shown in FIGS. 3*a* and 3*b*, embodiments of the present invention are directed to a waterproofing system 300 for sequestering and removing moisture seeping through the exterior walls 120 and/or floors of a structure from the living space. In some embodiments, the system 300 can comprise a vapor proof barrier 310, one or more fasteners 315, one or more spacers (not shown), and a gutter form 320 ("form").

The system can be implemented by first creating a trench 140 between the floor 130 and the wall 120. The vapor proof barrier 310 can then be attached to the wall 120 using a suitable method. The vapor proof barrier 310 can be attached to the wall such that it forms and airtight seal at the tops and sides of the barrier. This can be achieved, for example and not limitation, with adhesive, tape, or sealant. The barrier 310 can prevent moisture that has penetrated the wall 120 from entering the room and can enable the moisture to condense on the barrier 310 and gravity feed down to the form 320. The barrier 310 can also contain radon, and other soil gases, and prevent them from entering the living space. The reduction of moisture and gas infiltration into the living space can improve air quality and prevent health and other problems.

The form 320 can be attached to the wall 120 using suitable fasteners 315. In some embodiments, the fasteners 315 can be, for example and not limitation, masonry nails or masonry screws. In some embodiments, the form 320 can be affixed to the wall using, for example and not limitation, construction adhesive, epoxy, or silicone. The form 320 can be preferably affixed to the wall using a collared masonry nail compatible with a pneumatic or ballistic nail gun.

The form 320 can be attached to the wall at an angle $\alpha$ that is below level. In other words, one end 345 of the form 320 is mounted higher than the other end 350 of the form 320, which can create pitch and facilitate water flow. In some embodiments, a can be dictated by the size of the wall 120. In other words, a very long wall 120 can dictate that a can be a relatively small angle, while a shorter wall can enable a greater angle $\alpha$ to be used. Water, seeking its level, flows very easily, however, and thus a can be a very small angle. This can enable a single, continuous piece of form 320 to be used across a long wall, which can prevent leaks and reduce installation time.

In some embodiments, shown in FIG. 4, the form 320 can comprise several novel features. In some embodiments, the form 320 can be manufactured from an extruded material. This can enable the form 320 to be manufactured with complex features, yet reduced production costs. In some embodiments, the form 320 can comprise extruded plastic or aluminum, though other suitable materials are contemplated. Extrusion can also enable the forms 320 to be manufactured in long pieces to minimize the number of joints required to span the length of an interior wall 120. This can minimize leaks from the forms 320 and decreases the labor costs of joining multiple sections during installation.

Figure 4A:
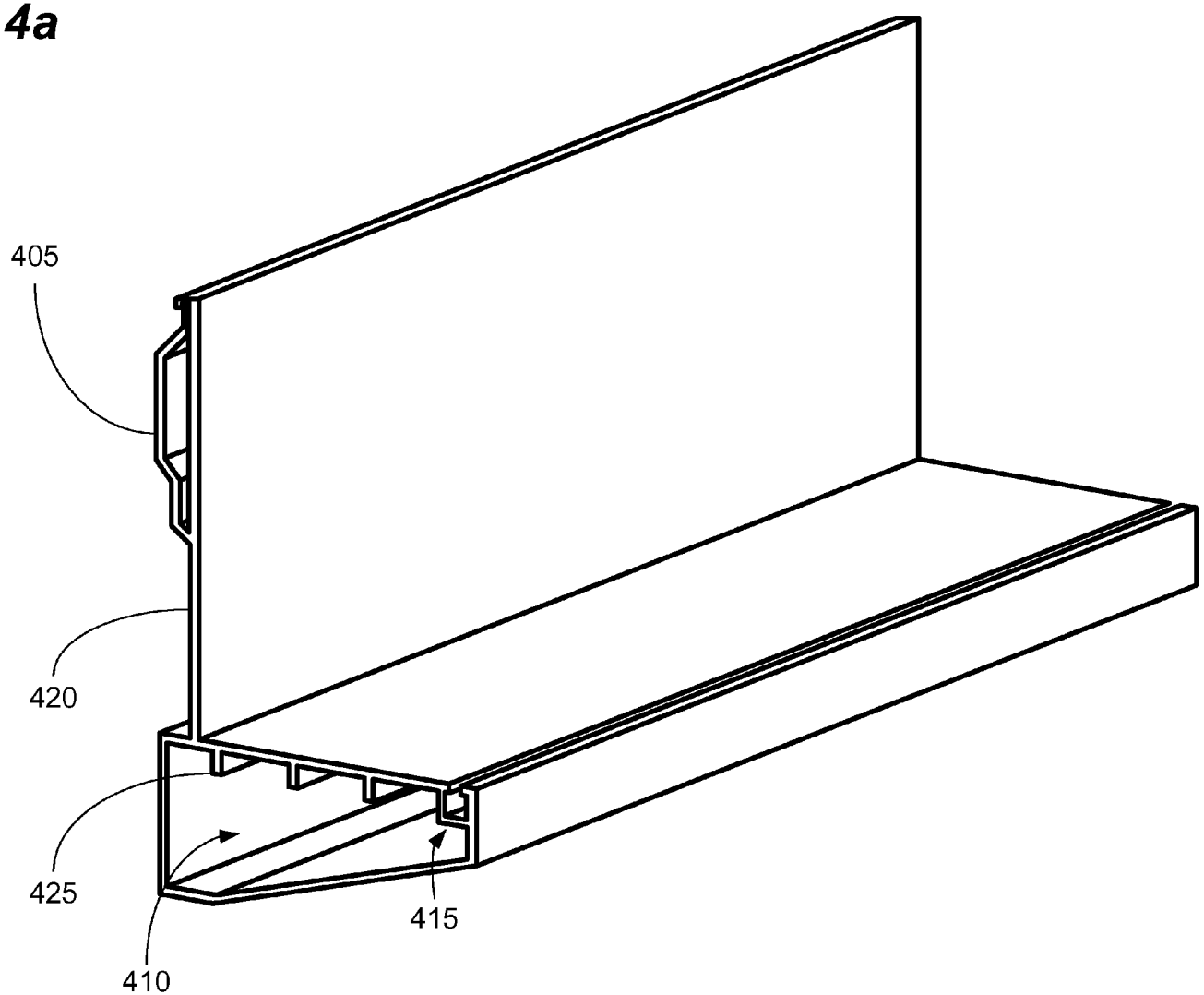
FIG. 4*a* depicts a perspective, side view of the waterproofing form in accordance with some embodiments of the present invention.
Figure 4B:
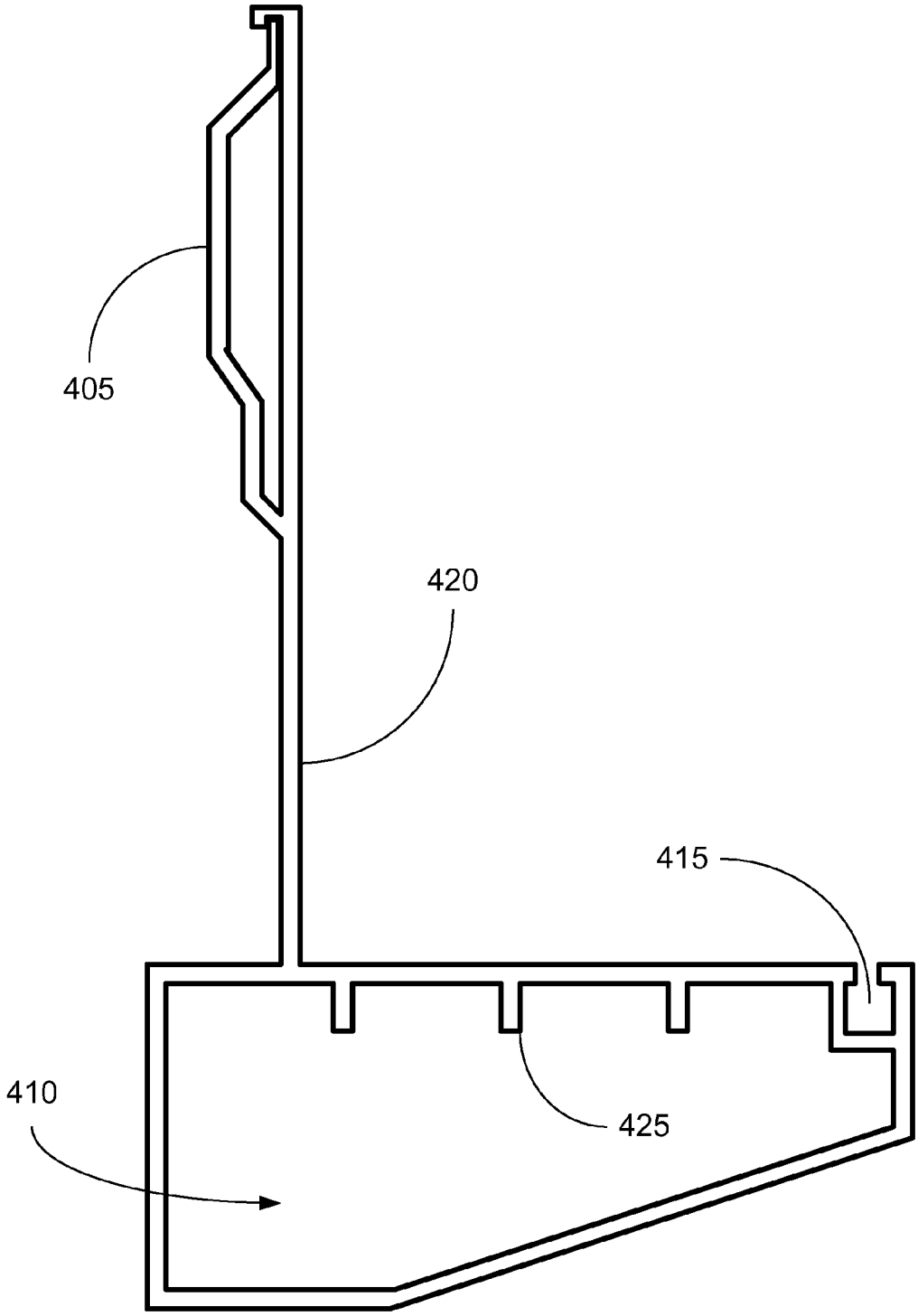
FIG. 4*b* depicts an end view of the waterproofing form in accordance with some embodiments of the present invention.

FIGS. 4*a* and 4*b* depict an exemplary profile for the form 320 according to some embodiments of the present invention. The extrusion process can enable the form 320 to be manufactured with a number of features including, but not limited to, a barrier retainer 405, a gutter channel 410, and a wick channel 415, an upright 420, and a plurality of stiffeners 425. The stiffeners 425 can increase the longitudinal stiffness of the form 320 and can enable the form 320 to span relatively long distances though it is made of a relatively pliable, extrudable material, like for example and not limitation, plastic or aluminum.

Figure 5B:
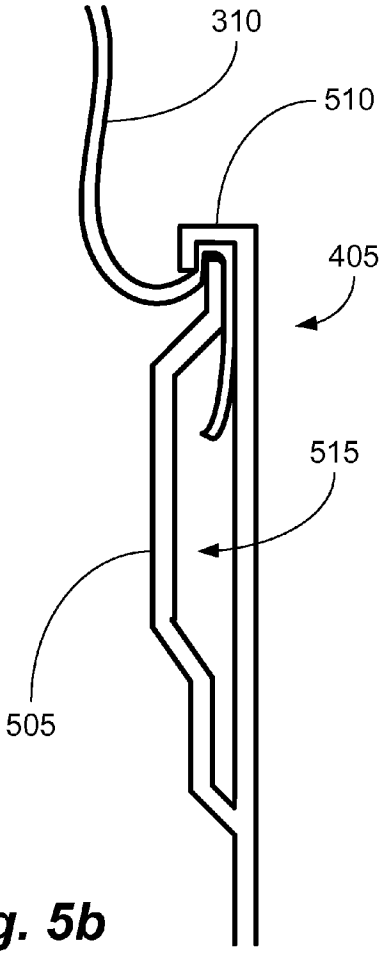
FIGS. 5*a*-5*b* depict an end view of a vapor barrier retainer in accordance with some embodiments of the present invention.
Figure 5A:
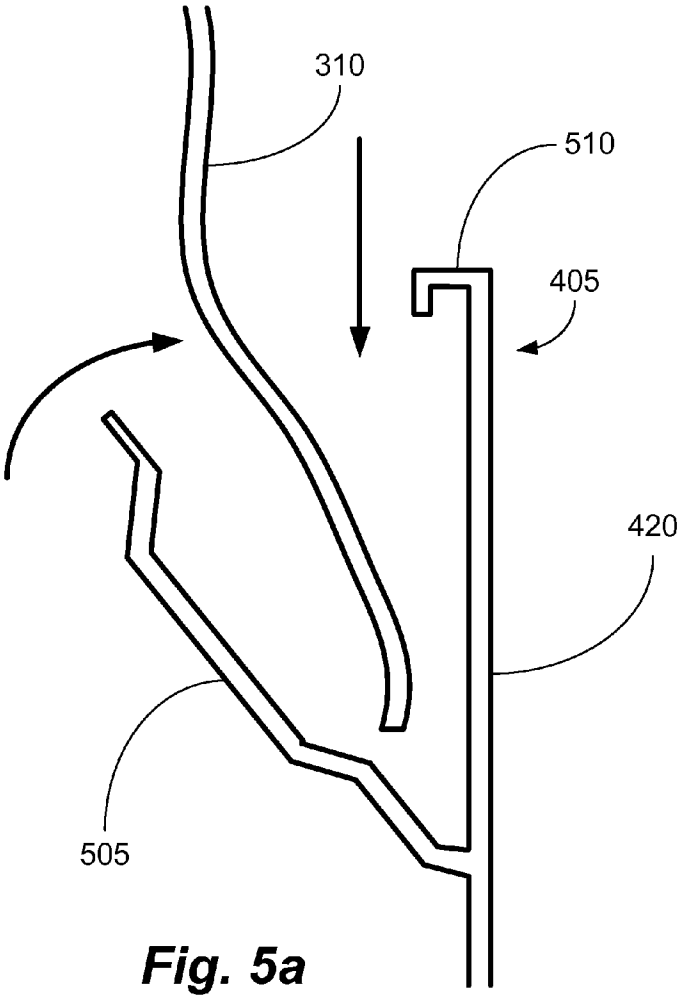
Figure 6:
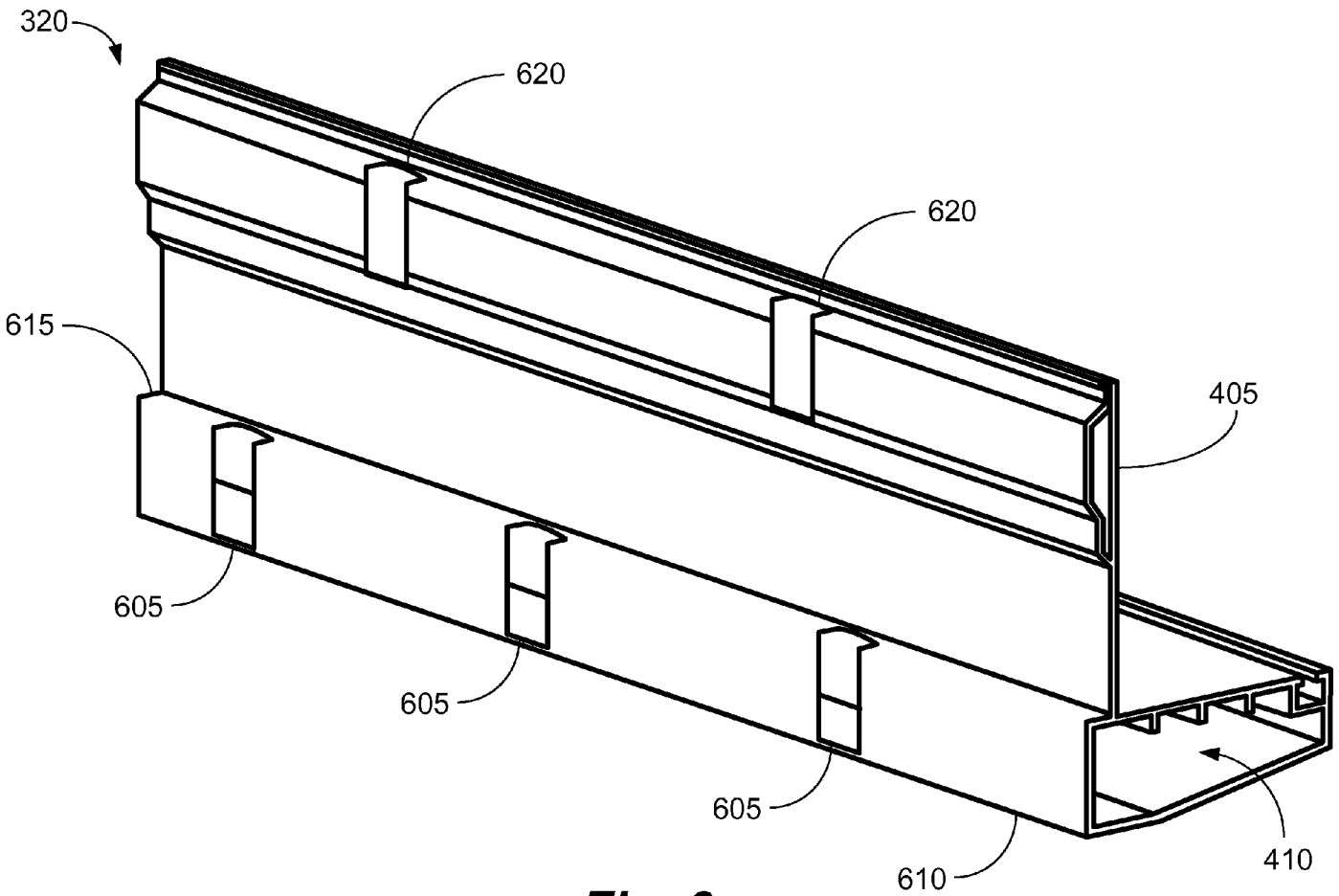
FIG. 6 depicts a rear, perspective view of the waterproofing form in accordance with some embodiments of the present invention.

As shown in FIGS. 5*a* and 5*b*, the barrier retainer 405 can comprise a portion of the upright 420, a flap 505, and a retainer 510. In some embodiments, the flap 505 can be molded such that it is hingeably attached to a back portion of the upright 420 such that the upright 420 and the flap 505 form a cavity 515 therebetween. In some embodiments, the flap 505 can be opened and the vapor proof barrier 310 can be inserted into the cavity 515. In some embodiments, the flap 505 can then be folded closed such that it snaps into, and is retained by, the retainer 510, which can form a portion of the top of the upright 420. In an alternative embodiments, the barrier 310 can be retained using other suitable means such as, for example and not limitation, adhesive, snaps, Velcro, or tape.

Regardless of the method of attachment to the form 320, the barrier 310 can direct water that has seeped through and is running down the wall 120 towards the form 320. In addition, because the barrier 310 is both liquid and vapor proof, the barrier 310 prevents the water from evaporating before it reaches the gutter channel 410 and prevents water from evaporating out of the gutter channel 410 before it can be removed. This can decrease the relative humidity in the surrounding room, which can improve indoor air quality, among other things. The barrier 310 can also prevent radon and other dangerous gases from entering the living space.

In some embodiments, the form 320 can further comprise one or more drain holes 605 disposed on a rear wall 610 of the gutter channel 410. The drain holes 605 can enable water running down the wall 120 to enter the gutter channel 410 for removal. Due to the geometry of the form 320, the rear wall 610 sits flush with the wall 120. Water that hits the form 320 in a place that does not have a drain 605, simply runs downhill (i.e., because the form is mounted at an angle $\alpha$) along the top wall 615 of the form 320 to the nearest drain hole 605.

In other embodiments, the barrier retainer 405 can further comprise drain holes 620. Due to the installation angle of the form, the cavity 515 formed by the barrier retainer 405 can provide an additional conduit through which water can travel to the collection source (i.e., a drain, sump pump, or other means). In other words, water can enter the cavity 515 in the barrier retainer 405 and can run downhill towards the collection area in the cavity 515.

Figure 7A:
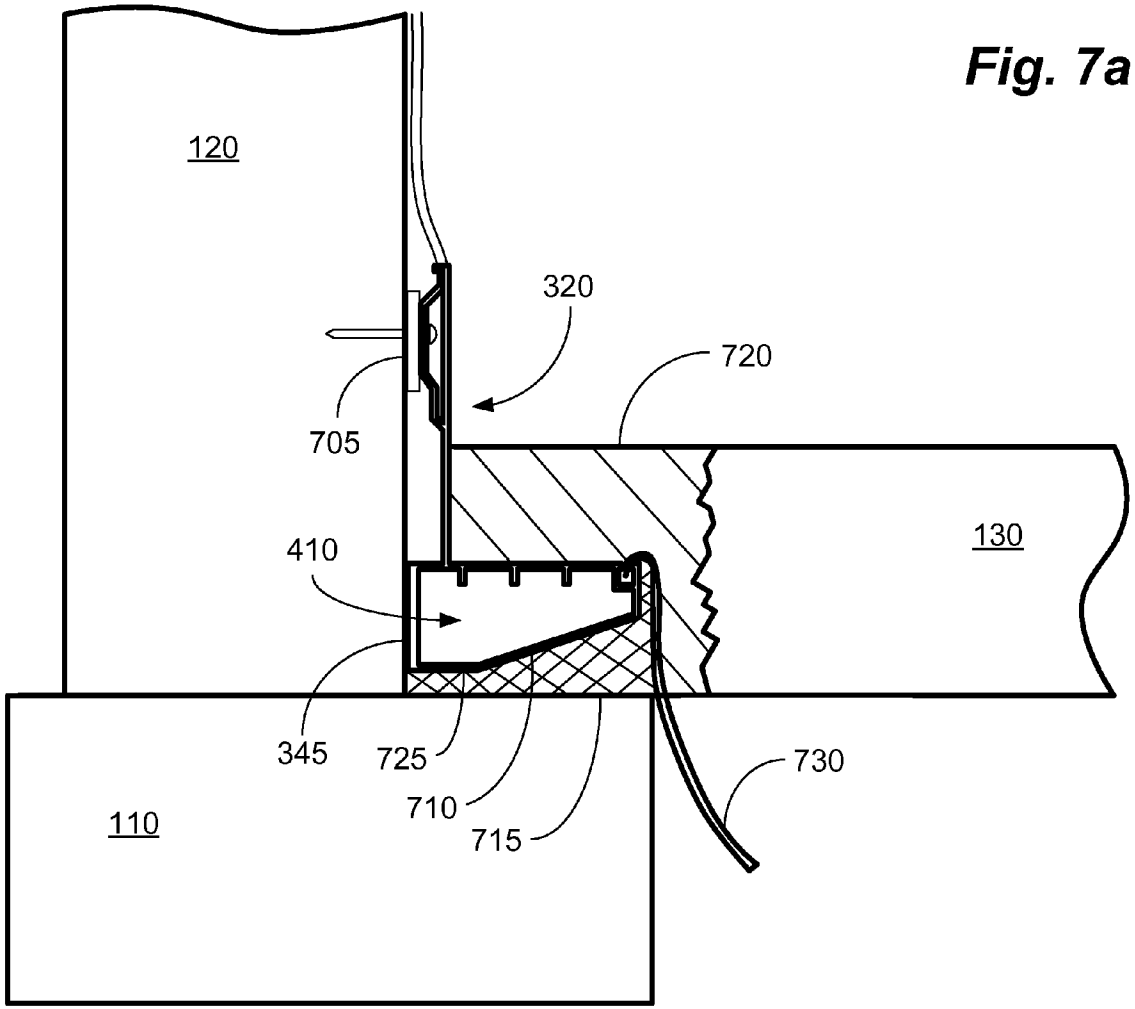
FIG. 7*a* depicts a side view of a high side of the waterproofing form, fully installed in the trench, in accordance with some embodiments of the present invention.
Figure 7B:
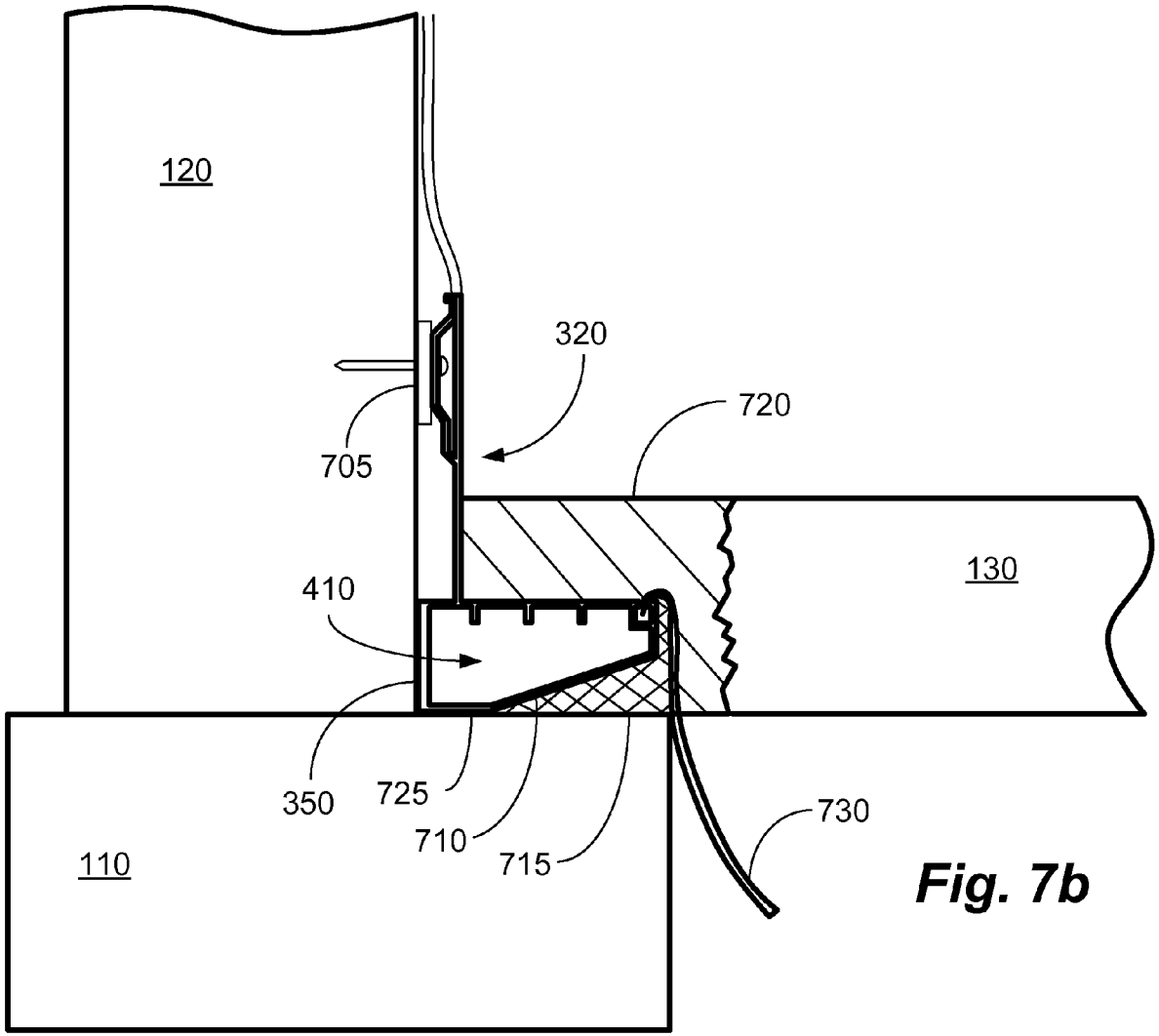
FIG. 7*b* depicts a side view of a low side of the waterproofing form, fully installed in the trench, in accordance with some embodiments of the present invention.

FIGS. 7*a* and 7*b* depict end views of a completed installation from both ends 345,350 of the form 320. FIG. 7*a* depicts the high end 345 of the form 320 after complete installation. In some embodiments, the form 320 can be attached to the wall using, for example and not limitation, masonry nails, masonry screws, adhesive, or tape. In a preferred embodiment, the form can be fastened to the wall with a collared pneumatic or ballistic fastener 315, a spacer 705, and a nail gun (not shown).

The spacer 705 can be manufactured from many suitable materials including, but not limited to, aluminum, plastic, or steel. In a preferred embodiment, the spacer 705 can be aluminum, though other suitable materials exist. The use of aluminum provides a spacer 705 that is soft enough for the fastener 315 to penetrate, but provides enough support to keep the fastener straight when it enters the wall 120. In other words, the spacer 705 can prevent the fastener 315 from deflecting when it hits a piece of aggregate, or other hard surface inside the wall 120, and enables the fastener 315 to be shot into the wall 120 at the intended angle.

Once affixed to the wall 120, the barrier 310 can be inserted into the barrier retainer 405 and the barrier retainer 405 can be snapped shut. The trench 140 can then be filled with concrete, cement, or other suitable material to restore the surface of the floor 130. In a preferred embodiment, the lower portion 715 of the trench 140, i.e., the area denoted by the cross hatched pattern, can be filled with a relatively thin product such as hydraulic cement with little or no aggregate. This can enable the area 715 below the form 320 to be filled and supported, and prevent voids that can be created by misplaced aggregate. The remaining portion 720 of the trench 140 can then be filled with concrete for strength.

In a preferred embodiment, a bottom wall 710 of the gutter channel 410 can be angled upwardly. This can enable water to be directed to a portion of the gutter channel 410, which can improve flow and facilitate collection. On the low end 350 of the form 320, depicted in FIG. 7*b*, the angled bottom wall 710 also enables the hydraulic cement, or other suitable material to get under and support the form, though the floor 725 of the form 320 is sitting flush with the bottom of the trench 140 (or in some cases, the top of the footing 110). This can improve the strength and stability of the form 320 and prevent cracking of the form 320 when it is covered with concrete.

In areas where there is, for example, a high water table, additional water seepage may occur through the floor 130. The weight of the structure can create significant hydrostatic pressure and can cause water to force its way through the floor 130. In still other embodiments of the present invention, therefore, the form 320 can further comprise a wick channel 415. The wick channel 415 can be used to retain a felt material 730 that is placed under the floor 130, or in other areas where there may be standing water problems, during installation. The felt material 730 can preferably comprise a material such as builder's felt on one side and a vapor barrier on the other. This can enable water trapped under the floor 130 to wick up the felt 730 and enter the wick channel 415.

Figure 8:
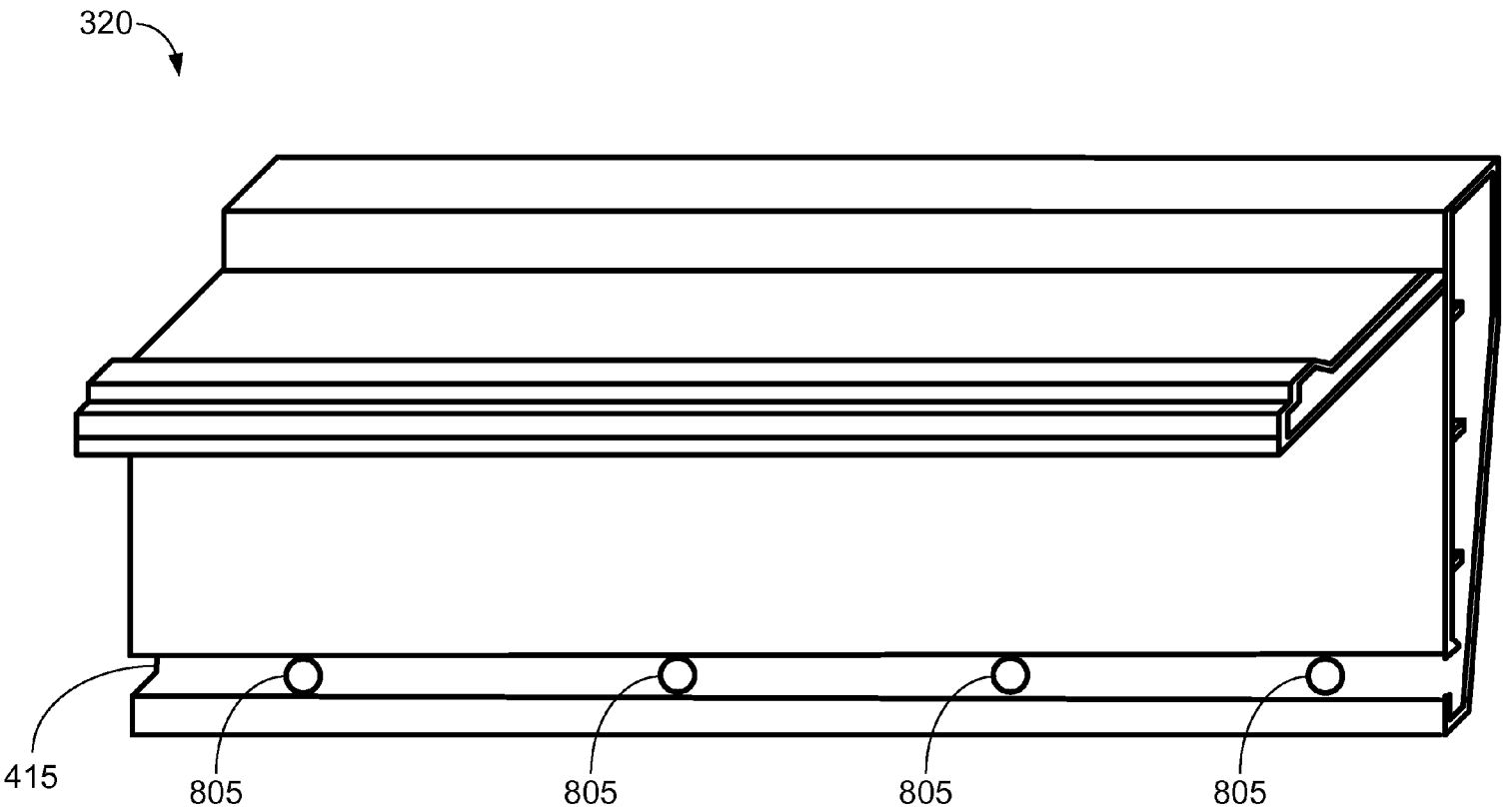
FIG. 8 depicts a top, perspective view of the waterproofing form in accordance with some embodiments of the present invention.

As shown in FIG. 8, water collected by the felt 730 can wick up the felt 730 and drip into the wick channel 415. The wick channel 415 is shaped to retain the felt 730 and to contain the water. In addition, because the wick channel 415 is also disposed at an angle $\alpha$, it provides a path for the water to travel downhill. The water can then enter the form 320 through drain holes 805 drilled or formed in the wick channel 415 and be directed to the collection area 360 via the gutter channel 410.

The collection area 360 for removing the water collected in the form 320 can be disposed at the low end of the form 320. In some embodiments, the form 320 can be tied into an existing drain in the structure. In other embodiments, the form 320 can be in fluid communication with a sump pit with a sump pump that pumps water into a drain, or other facility, to remove the water from the structure. In still other embodiments, the collection area 360 can comprise a conduit that exits the structure and empties, for example, into an existing outdoor French drain, or simply into the back yard. In a preferred embodiment, the conduit can further comprise a one-way valve to prevent water from back flowing into the structure and to prevent outside air from being drawn into the structure due to the "chimney effect" of the structure.

In some embodiments, the upper portion of the upright 420 can be left exposed above the level of the floor 130. This can enable the barrier 310 to be maintained or replaced without removing the entire system 300. In some embodiments, the form 320 can be extruding from plastic and the color can be chosen to match various interior colors in the living space. In other embodiments, the form 320 can be extruded from aluminum and painted, anodized, or otherwise treated to match various interior colors. In still other embodiments, the form 320 can be paintable, stainable, or otherwise colorable in place to enable users to match current or future interior colors. This can enable the system 300 to be installed in an unobtrusive manner.

Installation, according to some embodiments of the present invention can be achieved quickly and efficiently and can produce a system 300 with improved results over the prior art. The process can begin by assessing which walls 120 in a living space may be subject to water or gas infiltration. This can be determined by a visual inspection and/or moisture, chemical, or other testing. A trench 140 can be dug in the floor 130 next to any wall 120 suspected of said infiltration. A sump pit, drain tie-in, or other collection area 360 can be created to collect and remove water from the structure.

After measuring the length of the wall or walls 120 to be waterproofed, and allowing for the collection area 360, the form 320 can be cut to the desired length. The form 320 can then be placed in the trench 140—slightly above the bottom of the trench 140 on at least one end 345—and can be affixed to the wall 120 using a suitable method.

The form 320 can be attached to the wall at the desired mounting angle α, chosen to promote the flow of water from the high end 345 of the form to the low end 350, and subsequently to the collection area 360. The substantial rigidity of the form 320 enables the form 320 to be mounted in a substantially linear manner. The form 320 can be placed against the wall, the appropriate angle α can be set, using the form 320 itself and a simple angle finder or level, and then the form 320 can be mounted to the wall 120. Additionally, the mounting angle α of the form 320 inherently sets the gutter channel 410 (disposed therein) at the appropriate angle to promote water flow to the collection area 360.

Significantly, this angle α can be set regardless of the angle of the bottom of the trench 140 or the surface of the floor 130. This obviates the need to dig the trench 140 precisely or smooth and level the floor 130, as the mounting angle is set independently of the floor of the trench 140 and the floor 130. Additionally, any irregularities in the wall 120 have little or no effect on the mounting angle α, as they would tend to be lateral in orientation, and can be compensated for, if necessary, using spacers 705 of varying thickness.

The vapor barrier can be affixed to the wall 120 in an airtight manner. The vapor barrier 310 can be inserted in the vapor barrier retainer 405, which can provide a convenient, secure, vapor proof method of affixing the vapor barrier 310 to the form 320. This provides a vapor proof seal between the living space and all, or substantially all, of the surface of the wall 120, thus preventing vapor, gas, and other pollutants from entering the living space.

In some embodiments, such as areas with excessive rainfall, standing water, or high water tables the system 300 can further comprise a felt material 730. One end of the felt material 730 can be placed in an area of high moisture, while the other end can be retained in the wick channel 415 of the form 320. This can enable moisture to wick up the felt 730, drip into the wick channel 415, and then drip into the gutter channel 410 of the form 320 via drain holes 805 in the channel 415.

In some embodiments, the lower portion 715 of the trench 140 can then be filled with a thin binder that is substantially aggregate free, such as hydraulic cement. This can enable the cement to fill the void in the area 715 underneath the angled portion 710 of the form 320 to provide additional support to the form 320. In some embodiments, the upper portion 720 can be filled with an aggregate containing binder such as concrete. In other embodiments, both portions 715,720 can be filled with concrete.

From the forgoing, it can be seen that embodiments of the present invention provide a system 300 and method for providing a concrete encased gutter 410 for the removal of water from an interior space in a structure. The angle of the gutter 410, necessary to promote the drainage of water, is set using a form 320 attached to an interior wall 120. This obviates the need for among other things, precision digging, complicated concrete forms, and complex concrete pouring methods. The pitch angle of the gutter 410 is set by the mounting angle α of the form 320 during installation, and can be set independent of trench 140 and wall 120 geometry.

From the foregoing, it can also be seen that the invention provides a number of different systems, which can be used to sequester and remove moisture from the inside of a structure. The system of the present invention is simple and easily installed, and provides a permanent solution to this ubiquitous problem. The various embodiments of the invention described above provide methods of installing the system when compared with prior approaches.

It will be appreciated by those skilled in the art, however, that the invention can be embodied in other specific forms without departing from the spirit or essential characteristics thereof. For example, embodiments of the invention have been described with respect to a method of installation; however, the system 300 could be installed using a different sequence of steps, or omitting certain steps, without deviating from the spirit of the invention. In addition, while the invention has been described in the context of a moisture containment and removal system, the concepts described herein need not be limited to these illustrative embodiments.

The specific configurations, choice of materials, and the size and shape of various elements could be varied according to particular design specifications or constraints requiring a system constructed according to the principles of the invention. Such changes are intended to be embraced within the scope of the invention.

The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A method for waterproofing comprising:

creating a trench by removing a portion of a floor where the floor abuts a first surface of a wall;

attaching a vapor barrier to a portion of the first surface of the wall;

attaching a waterproofing form to the first surface of the wall with a fastener, the waterproofing form being attached to the wall at a mounting angle;

providing a collection means for collecting water collected in the waterproofing form;

inserting the vapor barrier into a vapor barrier retainer on the waterproofing form;

inserting a first end of a wicking material in a wicking channel located on the waterproofing form;

positioning a second end of the wicking material underneath the floor to wick water from underneath the floor into the waterproofing form; and filling the trench to restore the portion of the floor previously removed;

wherein water flows through the waterproofing form to the collection area due to the mounting angle.

2. The method of claim 1, wherein attaching the waterproofing form to the first surface of the wall with the fastener comprises:

inserting a spacer between the waterproofing form and the first surface of the wall; and inserting the fastener through a portion of the waterproofing form and the spacer and into the wall.

3. The method of claim 1, wherein the mounting angle is between 0.5 and 15 degrees below level.

4. The method of claim 1, wherein filling the trench further comprises:

filling a lower portion of the trench with a first binder that is substantially free of aggregate; and filling the remainder of the trench with a second binder that contains aggregate.

5. The method of claim 1, wherein the mounting angle is determined by the first surface of the wall.

6. The method of claim 1, wherein at least a portion of the waterproofing form is disposed above the level of the floor.

7. A method of installing a waterproofing system, the method comprising:

creating a trench in a floor proximate an area of the floor that abuts a wall;

placing a waterproofing form at least partially within the trench;

affixing a vapor barrier to a portion of the wall, the vapor barrier comprising a sheet of material operable to substantially prevent the flow of liquid from a first side of the sheet to a second side of the sheet;

attaching the vapor barrier to a first portion of the waterproofing form by inserting at least a portion of the vapor barrier into a vapor barrier retainer of the waterproofing form and closing a flap of the vapor barrier retainer to secure the vapor barrier in place;

attaching a second portion of the waterproofing form to the wall; and adding one or more binders into the trench.

8. The method of claim 7, wherein a first binder of the one or more binders is substantially aggregate free.

9. The method of claim 8, wherein a second binder of the one or more binders comprises aggregate.

10. The method of claim 9, wherein at least one of the first binder and the second binder comprise concrete.

11. The method of claim 7, further comprising forming a first binder of the one or more binders so that at least a portion of the first binder supports the waterproofing form.

12. The method of claim 7, further comprising attaching the waterproofing form to the wall at a non-level angle.

13. The method of claim 12, wherein attaching the second portion of the waterproofing form to the wall comprises:

inserting a spacer between the waterproofing form and the wall; and inserting a fastener through a portion of the waterproofing form and the spacer and into the wall.

14. The method of claim 7, further comprising:

placing a first end of a wicking material into a wicking channel of the waterproofing form; and placing a second end of the wicking material under the floor;

wherein the wicking material is operable to wick liquid from under the floor into the wicking channel.

15. The method of claim 7, further comprising providing a collection area for liquid that flows through the waterproofing form, the collection area located proximate a low end of the waterproofing form.

16. A method of using a waterproofing form, the method comprising:

positioning the waterproofing form in a trench of a floor, the trench located proximate an area where the floor abuts a wall and the waterproofing form comprising a vapor barrier retainer having a flap and a retainer, the flap hingeably coupled to an upright portion of the waterproofing form and the retainer configured to retain the flap in a closed position;

attaching a vapor barrier to the waterproofing form by inserting the vapor barrier at least partially within the vapor barrier retainer and closing the flap into the retainer such that the vapor barrier is trapped between the flap and the retainer, the vapor barrier attached to the wall and capable of substantially preventing the flow of liquid through the vapor barrier; and pouring binder into the trench to form a masonry flume around the waterproofing form.

17. The method of claim 16, further comprising attaching the waterproofing form to the wall at a non-level angle so that liquid flows from a higher portion of the masonry flume to a lower portion of the masonry flume.

* * * * *